US005630388A

United States Patent [19]

Eaton

[11] Patent Number: 5,630,388

[45] Date of Patent: May 20, 1997

[54] STARTER MECHANISM FOR SMALL ENGINES

[76] Inventor: Daniel L. Eaton, 74 W. Lamoka Ave., Savona, N.Y. 14879

[21] Appl. No.: 650,327

[22] Filed: May 20, 1996

[51] Int. Cl.[6] ..... F02N 3/04

[52] U.S. Cl. ..... 123/185.4

[58] Field of Search ..... 123/185.4, 185.3, 123/185.2

[56] References Cited

U.S. PATENT DOCUMENTS

| | | | |
|---|---|---|---|
| 4,109,538 | 8/1978 | Glenday et al. | 123/185.2 |
| 5,133,312 | 7/1992 | Shede | 123/185.2 |

FOREIGN PATENT DOCUMENTS

| | | | |
|---|---|---|---|
| 60-224957 | 11/1985 | Japan | 123/185.4 |

*Primary Examiner*—Andrew M. Dolinar

*Attorney, Agent, or Firm*—Robert J. Bird

[57] ABSTRACT

A machine includes a frame, an engine with a rope operated rewind starter, a handle connected to the frame, and the following improvement: a differential pulley with a driver pulley wheel and a driven pulley wheel rotatable on the handle with the engine starter rope connected to the driven pulley wheel; a foot operated starter lever for pivotal up and down movement; and a driver rope connected to the starter lever and to the driver pulley wheel. Downward pivotal movement of the starter lever pulls the driver rope and, through the differential pulley, the starter rope to start the engine.

4 Claims, 2 Drawing Sheets

STARTER MECHANISM FOR SMALL ENGINES

FIELD OF THE INVENTION

This invention relates to small engines, such as lawn mower engines, and more specifically to a starter mechanism for such an engine.

BACKGROUND AND INFORMATION DISCLOSURE

A typical small gasoline engine, such as a power lawn mower engine, is started by means of a starter rope, pulled by hand. If the engine is in good working order, this method may be entirely satisfactory for most users. However, it does require some effort, and some persons do not have the required arm strength. If the engine is out of adjustment or the spark plug is fouled, it may be still more difficult to start and may require more repetitions of the effort.

SUMMARY OF THE INVENTION

The object of this invention is to provide a foot operated starter system for lawn mower engines and other such engines.

A machine according to this invention includes a frame, an engine with a rope operated rewind starter, a handle connected to the frame, and the following improvement: a differential pulley with a driver pulley wheel and a driven pulley wheel rotatable on the handle with the engine starter rope connected to the driven pulley wheel; a foot operated starter lever for pivotal up and down movement; and a driver rope connected to the starter lever and to the driver pulley wheel. Downward pivotal movement of the starter lever pulls the driver rope and, through the differential pulley, the starter rope to start the engine.

DRAWING

DESCRIPTION OF PREFERRED EMBODIMENT

Figure 1:
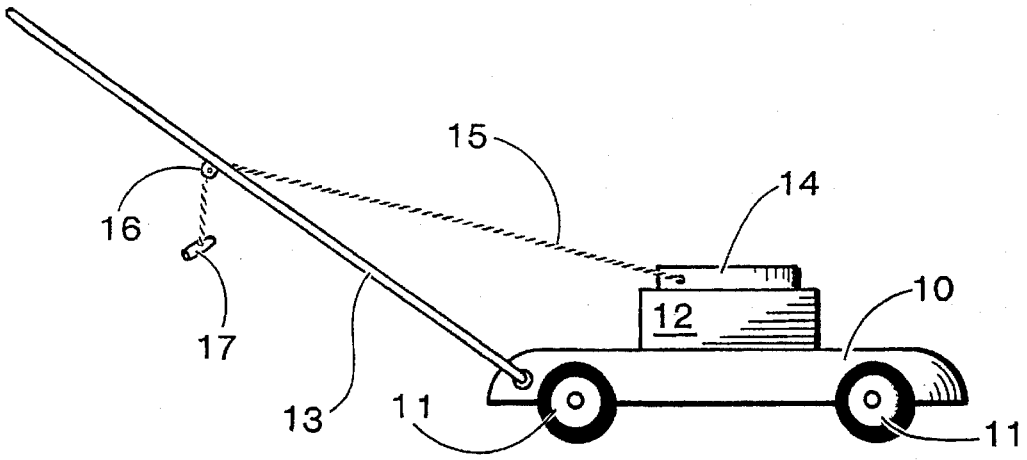
Fig. 1 (PRIOR ART)
FIG. 1 is a somewhat schematic side view of a typical lawn mower of the prior art.

Referring to FIG. 1, a typical mower includes a frame 10 mounted on wheels 11, an engine 12 mounted on the frame 10, and a mower handle 13 extending up and out from the frame 10. The engine 12 includes a rewind starter mechanism 14. A starter rope 15 extends from the starter 14 and through a rope guide 16 at an intermediate point on the handle 13, and includes a rope handle 17 on its end. The handle 13 is pivotally mounted to the frame 10 at pivot points 18. To start the engine, the starter rope 15 is typically pulled about two feet.

Figure 2:
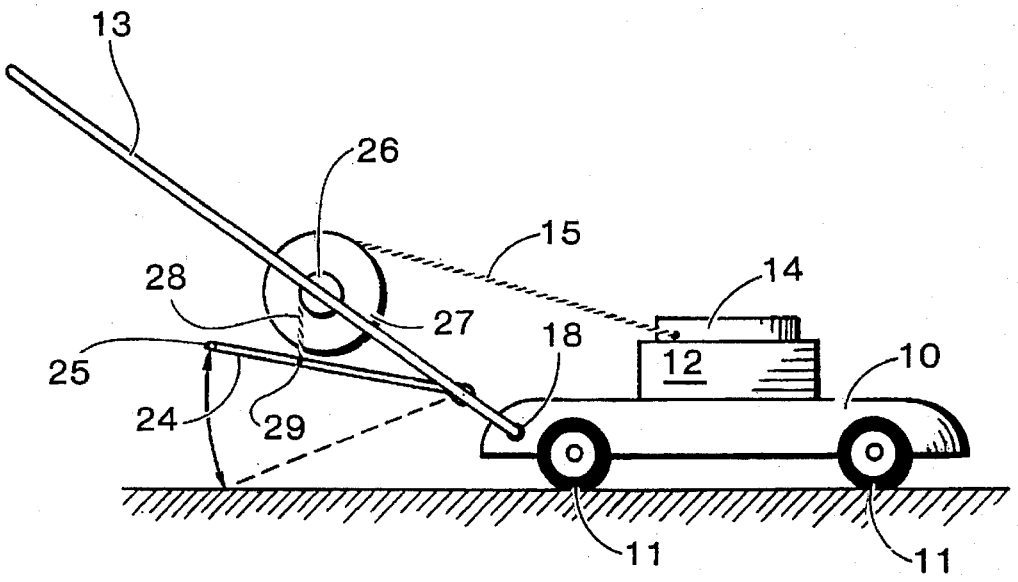
FIG. 2 is a similar side view of a lawn mower with a starter mechanism according to this invention.
Figure 3:
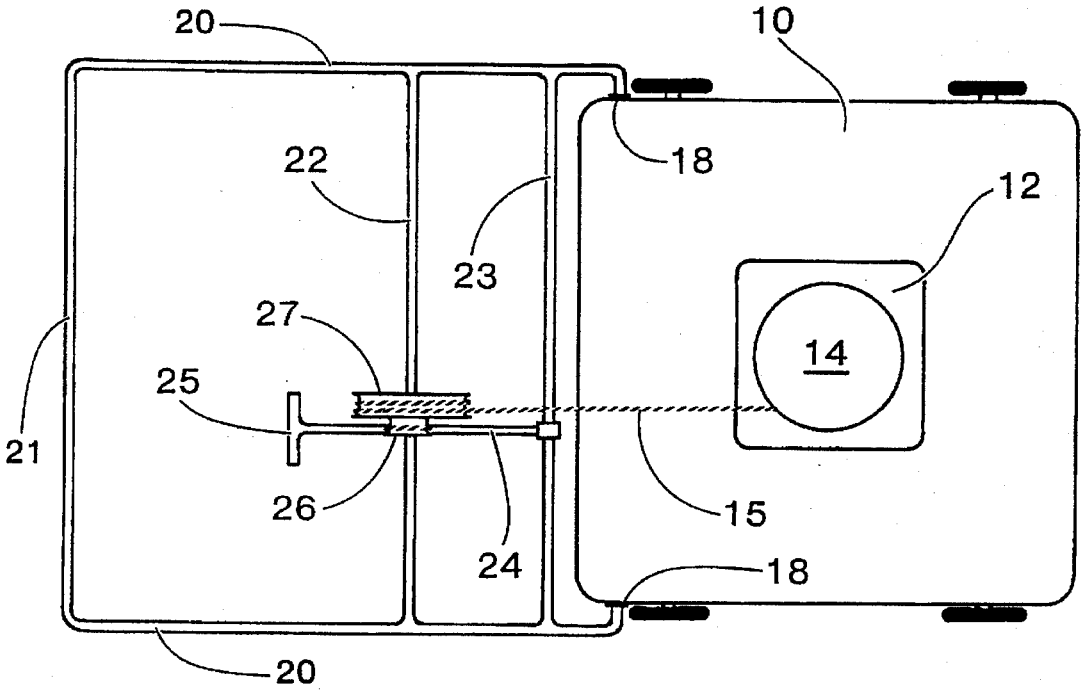
FIG. 3 is a top view of the mower of FIG. 2.

A mower with a starter mechanism according to this invention is shown in FIGS. 2 and 3. It includes a frame 10, wheels 11, engine 12, handle 13, rewind starter 14, and a starter rope 15, as in FIG. 1. The handle 13 includes parallel side members 20 pivotally connected to the frame 10, a handle bar 21 connecting their outer ends, an intermediate cross bar 22, and a lower cross bar 23. A starter lever 24 extends radially out from the lower cross bar 23 for pivotal movement up and down through an arcuate path as indicated in FIG. 2. The starter lever 24 includes a foot pedal 25 at its outer end.

The intermediate cross bar 22 supports a differential pulley, including a driver pulley wheel 26 of smaller diameter and a driven pulley wheel 27 of larger diameter, rotatable together on the intermediate cross bar 22. The starter rope 15 from the rewind starter 14 is connected to and wound around the driven pulley wheel 27. A driver rope 28 is connected to and wound around the driver pulley wheel 26, and is connected at a suitable connection point 29 to the starter lever 24.

Downward push on the foot pedal 25 and starter lever 24 pulls the driver rope 28 down to rotate the driver pulley wheel 26 and the driven pulley wheel 27. The driven pulley 27, in turn, pulls the starter rope 15 to start the engine.

The driver pulley wheel 26 is smaller in diameter than the driven pulley wheel 27. Displacement of the driver rope 28 will multiply the displacement of the starter rope 15 by a factor equal to the ratio of the diameters of their respective pulley wheels 27 and 26. If, for example, the pulley wheels are respectively 4" and 8" in diameter, one foot of downward movement of the driver rope 28 will pull the starter rope 15 two feet.

The handle 13 with parallel side members 20 is more or less standard on mowers of the present time. That configuration lends itself to this invention by the simple addition of cross bars 22 and 23 on which the other parts are mounted. That configuration is not essential, however. The starter lever 24 can be pivotally mounted on the frame 10 instead of a lower cross bar, and a lower cross bar would not be needed. The pulleys 26,27 can be mounted on a cantilevered spindle extending out from a single centered handle, instead of the two sided handle 13. Also, in the configuration shown, the pulleys 26, 27 are locked together and are therefore necessarily on the same axis. This is undoubtedly the simplest form of pulley arrangement, but it is not the only form it might take. The driver pulley 26 and driven pulley 27 could be on different axes, and geared or belted for rotation together.

If a lawn mower includes a bagger directly below the handle, the bagger will be in the way of the starter lever 24 as it is shown in FIG. 3. In that case it will be desirable to move the starter lever from a position close to the driven pulley wheel 27 (as in FIG. 3) to a position near the right side member 20, and perhaps even on the opposite side of that member. This will require spacing the driver pulley wheel 26 from the driven pulley wheel 27 by extending the axial length of the differential pulley.

Dimensions are not critical to this invention. The relative sizes of the driver pulley wheel 26 and the driven pulley wheel 27 will be matters of choice depending on such factors as the required travel of the starter rope, the available space for foot pedal travel, and an acceptable mechanical disadvantage from pulley diameter differential.

The foregoing description of a preferred embodiment of this invention, including any dimensions, angles, or proportions, is intended as illustrative. For convenience I have described my starter system in connection with a lawn mower engine. It is not limited to use on a lawn mower, of course, but may be applicable to small engines generally. The concept and scope of the invention are limited only by the following claims and their equivalents.

What is claimed is:

1. A machine including a frame, an engine with a rewind starter mounted on said frame and a starter rope operatively connected to said starter, an operator handle connected to said frame, and the improvement comprising:

a pulley mechanism with a driver pulley wheel and a driven pulley wheel disposed on said handle, said driver pulley wheel operatively connected to said driven pulley wheel, said driven pulley wheel operatively connected to said starter rope;

a foot operated starter lever pivotally mounted for movement up and down; and a driver rope from said starter lever operatively connected to said driver pulley wheel;

whereby said starter lever is adapted to pull said driver rope and, through said pulley mechanism, said starter rope to start said engine.

2. A machine including a frame, an engine with a rewind starter mounted on said frame and a starter rope operatively connected to said starter, an operator handle with opposite side members connected to said frame and a handle bar connecting their outer ends, and the improvement comprising:

an intermediate cross bar on said handle between said handle bar and said frame:

a differential pulley with a driver pulley wheel and a driven pulley wheel rotatably mounted on said intermediate cross bar, said driven pulley wheel operatively connected to said starter rope;

a foot operated starter lever pivotally mounted for movement up and down; and a driver rope from said starter lever operatively connected to said driver pulley wheel;

whereby said starter lever is adapted to pull said driver rope and, through said differential pulley, said starter rope to start said engine.

3. A machine including a frame, an engine with a rewind starter mounted on said frame and a starter rope operatively connected to said starter, an operator handle with opposite side members connected to said frame and a handle bar connecting their outer ends, and the improvement comprising:

an intermediate cross bar on said handle between said handle bar and said frame;

a differential pulley with a driver pulley wheel and a driven pulley wheel rotatably mounted on said intermediate cross bar, said driven pulley wheel operatively connected to said starter rope;

a lower cross bar on said handle between said intermediate cross bar and said frame;

a foot operated starter lever mounted on said lower cross bar for pivotal up and down movement; and a driver rope from said starter lever operatively connected to said driver pulley wheel;

whereby said starter lever is adapted to pull said driver rope and, through said differential pulley, said starter rope to start said engine.

4. A machine as defined in claim 3 in which said driver pulley wheel is smaller in diameter than said driven pulley wheel, the displacements of said driver rope and said starter rope thereby being in the same proportion as the diameters of their respective pulley wheels.

* * * * *